US009353463B2

(12) United States Patent
Stahlecker et al.

(10) Patent No.: US 9,353,463 B2
(45) Date of Patent: May 31, 2016

(54) SPINNING POINT OF A SPINNING MACHINE AND METHOD FOR THE OPERATION OF THE SAME

(71) Applicant: Maschinenfabrik Rieter AG, Winterthur (CH)

(72) Inventors: Gerd Stahlecker, Eislingen/Fils (DE); Markus Kübler, Geislingen (DE); Gernot Schäffler, Wäschenbeuren (DE); Evzen Pilar, Litomysl (CZ); Javier-Orlando Ricaurte-Rubio, Gingen (Fils) (DE)

(73) Assignee: Maschinenfabrik Rieter AG, Winterthur (CH)

( * ) Notice: Subject to any disclaimer, the term of this patent is extended or adjusted under 35 U.S.C. 154(b) by 109 days.

(21) Appl. No.: 14/218,033

(22) Filed: Mar. 18, 2014

(65) Prior Publication Data

US 2014/0283496 A1 Sep. 25, 2014

(51) Int. Cl.
*D01H 1/115* (2006.01)
*D01H 4/48* (2006.01)
(Continued)

(52) U.S. Cl.
CPC ..... *D01H 1/115* (2013.01); *B65H 51/205* (2013.01); *B65H 67/081* (2013.01); *D01H 4/02* (2013.01); *D01H 4/48* (2013.01); *D01H 4/50* (2013.01); *D01H 15/00* (2013.01); *B65H 2701/31* (2013.01)

(58) Field of Classification Search
CPC .... B65H 67/081; B65H 51/205; D01H 13/22; D01H 15/00; D01H 4/40; D01H 4/48
USPC ..... 57/22, 23
See application file for complete search history.

(56) References Cited

U.S. PATENT DOCUMENTS 4,132,056 A 1/1979 Hüsges et al.
4,953,800 A 9/1990 Okubo et al.
(Continued)

FOREIGN PATENT DOCUMENTS

DE 25 53 892 6/1977
DE 10 2007 038 871 A1 2/2008
(Continued)

OTHER PUBLICATIONS

German Patent Office Search Report, Dec. 16, 2013.
(Continued)

*Primary Examiner* — Shaun R Hurley
(74) *Attorney, Agent, or Firm* — Dority & Manning, P.A.

(57) ABSTRACT

A spinning point of a spinning machine includes a spinning unit, a drawing-off device for the yarn downstream of the spinning unit and a yarn storage downstream of the drawing-off device for the intermediate storage of a section of yarn. The yarn storage has a sensor system for monitoring the filling level of the yarn storage (7). The spinning point includes a winding device for the yarn downstream of the yarn storage, along with a return unit, with the assistance of which an end of the yarn found within the yarn storage after a yarn break is returned into the area of the spinning point. The winding device (9) is stopped in the case of a yarn break in such a manner that, after the stop, an end section of the yarn remains within the yarn storage (7). Subsequent to this, a part of the yarn is separated with the assistance of a yarn separation unit internal to the spinning point, and that the end of the yarn that newly arises in this manner is returned with the assistance of the return unit internal to the spinning point into the area of the spinning point, and that a piecing process is then carried out.

19 Claims, 12 Drawing Sheets

(51) Int. Cl.

| | |
|---|---|
| ***D01H 15/00*** | (2006.01) |
| ***D01H 4/02*** | (2006.01) |
| ***D01H 4/50*** | (2006.01) |
| ***B65H 51/20*** | (2006.01) |
| ***B65H 67/08*** | (2006.01) |

(56) References Cited

U.S. PATENT DOCUMENTS

| | | | | |
|---|---|---|---|---|
| 5,327,712 | A * | 7/1994 | Dallmann | B65H 51/205 57/22 |
| 6,402,079 | B1 * | 6/2002 | Hermanns | B65H 69/00 242/475.4 |
| 7,036,300 | B2 * | 5/2006 | Brandl | D01H 4/50 57/22 |
| 7,500,344 | B2 * | 3/2009 | Badiali | B65H 51/205 57/22 |
| 2003/0029153 | A1 * | 2/2003 | Straaten | D01H 4/50 57/263 |
| 2003/0038206 | A1 | 2/2003 | Grecksch et al. | |
| 2003/0167747 | A1 * | 9/2003 | Schatton | B65H 69/063 57/22 |
| 2007/0028585 | A1 | 2/2007 | Grecksch et al. | |
| 2007/0125061 | A1 | 6/2007 | Schaeffler | |

FOREIGN PATENT DOCUMENTS

| | | |
|---|---|---|
| EP | 2 184 387 A1 | 5/2010 |
| JP | 9-157970 | 6/1997 |
| WO | WO 2012/127939 A1 | 9/2012 |

OTHER PUBLICATIONS

EP Search Report, Aug. 29, 2014.

* cited by examiner

SPINNING POINT OF A SPINNING MACHINE AND METHOD FOR THE OPERATION OF THE SAME

FIELD OF THE INVENTION

This invention relates to a spinning point of a spinning machine that serves the purpose of producing a yarn from a fiber composite supplied to the spinning point in a direction of transport. In addition, a method for operating a spinning point is proposed, whereas, during the spinning process, the yarn produced in the spinning point is drawn from the spinning point with the assistance of a drawing-off device. The drawn off yarn is monitored with the assistance of a yarn monitor regarding at least one physical parameter, and the drawn off yarn passes through a yarn storage, wherein the filling level of the yarn storage is monitored with the assistance of a sensor system. The yarn is wound on with the assistance of a winding device after passing through the yarn storage and the winding speed of the winding device is controlled depending on the filling level of the yarn storage.

BACKGROUND

The following description generally refers to a spinning machine, which is suitable for producing a yarn from a fiber composite presented to it. This includes, in particular, air-jet spinning machines and rotor spinning machines, the basic structure of which is known from the state of the art (whereas, within the framework of the invention, air-jet spinning machines for the production of a finished yarn along with air-jet spinning machines, with the assistance of which roving (coarse roving) can be produced, should be included).

It is known that, in the course of the actual spinning process (i.e. the error-free production of yarn), the unwanted tearing of the yarn may repeatedly occur. It also cannot be ruled out that, from time to time, the spinning machine produces yarn sections with inferior quality (i.e., the occurrence of sections of yarn, the parameters of which, for example, yarn thickness, hairiness, yarn strength, etc. deviate from a predetermined target value). Typically, the corresponding yarn faults are detected by a yarn monitor allocated to the respective spinning point, and must be removed in a cleaner cut that interrupts the spinning process. This ultimately gives rise to, in addition to the tearing of the yarn, an end of the yarn on the winding-on side that must be connected in a subsequent piecing process with the fiber composite presented at the corresponding spinning point, in order to once again go through the normal spinning operation.

However, in order to be able to conduct a corresponding piecing process, the respective end of the yarn wound on the spool must be, manually or with the assistance of a service robot patrolling along the spinning point, initially searched for on the surface of the spool and removed from it, in order to ultimately supply it against the actual spinning direction of the spinning point and connect it with the fiber composite. In addition, a certain section of yarn is typically removed prior to the piecing, since the present end of the yarn is usually not suitable for the piecing process and/or contains yarn faults detected by the yarn monitor.

Since the service robot must proceed initially to the respective spinning point prior to the piecing process, and only one spinning point may be wound by one robot, the necessary piecing processes result in considerable limitations to the spinning process. Thereby, the piecing processes after the cleaner cuts to be increasingly conducted for the air-jet spinning machines particularly contribute to a significant impairment of the productivity of the air-jet spinning machines.

SUMMARY OF THE INVENTION

Therefore, a task of this invention is to propose a spinning point along with a method for the operation of the same, with the assistance of which the piecing times, in particular after a cleaner cut, may be reduced in respect of the state of the art. Additional objects and advantages of the invention will be set forth in part in the following description, or may be obvious from the description, or may be learned through practice of the invention.

The tasks are solved by a spinning point and a method with the characteristics of the appended patent claims.

According to the invention, the spinning point initially includes a spinning unit with tools for the production of yarn, whereas the tools may comprise, for example, a rotor of a rotor spinning machine or the vortex chamber of an air-jet spinning machine. Furthermore, a drawing-off device downstream of the spinning unit as seen with respect to the direction of transport of the fiber composite and/or the yarn is provided for the drawing off of the yarn from the spinning unit, which may comprise, for example, a pair of guiding draw-off rollers clamping the yarn. Furthermore, a yarn storage downstream of the drawing-off device for the intermediate accumulation of a section of yarn is provided. In this connection, the term "intermediate accumulation" is understood to mean that the yarn passes through the intermediate storage during its transport to the winding device. In other words, a certain section of the yarn is always within the yarn storage, such that fluctuations in the winding speed of the winding device and/or the drawing-off device and/or fluctuations in the delivery speed of the spinning unit (i.e., the speed of the yarn exiting the spinning unit) may be compensated, whereas this leads to a (partial) filling or emptying, as the case may be, of the yarn storage.

In order to be able to keep the filling level of the yarn storage (i.e. the length of the yarn section in the yarn storage) approximately constant or within predetermined limit values, as the case may be, it is also provided that the spinning point contains a sensor system for monitoring the filling level of the yarn storage. The sensor system is preferably placed in the area of or the interior of the yarn storage and designed to detect the presence of a yarn in predefined spots of the yarn storage or the length of the yarn section in the yarn storage.

On the basis of the data provided by the sensor system, it is ultimately possible to control the winding speed of a winding device for the yarn downstream of the yarn storage in the direction of transport, whereas the winding device for this is preferably connected to a controller that is fed with the data measured by the sensor system. If the controller determines that the length of the yarn section in the yarn storage (or the yarn loop in the yarn storage) is below a minimum, the winding speed of the winding device decreases, until the length once again corresponds to a defined minimum amount. If the known length exceeds a predetermined maximum, the winding speed is increased accordingly.

Finally, the spinning point includes a return unit, with the assistance of which an end of the yarn, which is found within the yarn storage after a yarn break, is able to be returned to the area of the spinning point. Thus, as a result, what is proposed is a spinning point that is able to fix a yarn break regardless of its cause, by leading the resulting end of the yarn back to the spinning unit without the use of a service robot and the end of the yarn may be connected to the fiber composite (the individual step of the method will be more specifically described in connection with the method according to the invention). In addition, it must be generally noted at this point that, for the purposes of the invention, the term "yarn break" is understood to mean any unwanted or uncontrolled cutting off of a yarn section on the winding-on side from the fiber composite or an end of the yarn on the spinning unit side leaving the spinning unit.

It is advantageous if the return unit includes an air jet, with the assistance of which an air flow directed towards the spinning point is able to be generated. With the assistance of the corresponding air flow, it is possible to blow the end of the yarn found in the yarn storage in the direction of the spinning unit. In this area, it may be finally sucked in by the spinning unit and transported in the direction of the fiber composite, in order to be fed to the described piecing process. Such a return is desired particularly following the removal of a yarn fault, whereas, in this connection, reference is made to the description of the method according to the invention. The air jet is preferably connected to a controller, which is also connected to the yarn storage or the vacuum power source connected to the yarn storage. Thereby, it is possible to disable the yarn storage during the return of the end of the yarn in the direction of the spinning unit, in order to preclude the yarn storage from preventing a return of the end of the yarn in the area of the spinning unit.

It is particularly advantageous if the return unit includes a mechanically operated return element, for example a lever assembly that is able to be brought into contact with the yarn. The return element may be placed, for example, in the area of a yarn intake opening of the yarn storage. In particular, the return element should be arranged in such a manner that, upon its movement, it is able to be brought into contact with the yarn, in order to be able to, after a yarn break, capture the end of the yarn that is present and preferably fixed with the assistance of the yarn storage, and move it into the area of a yarn outlet opening of the spinning unit. This ultimately enables a return of the end of the yarn into the area in which it is connected to the fiber composite in the course of the piecing process.

It is advantageous if the sensor system includes at least two sensors spaced from each other, with the assistance of which the presence of the yarn in the area of the respective sensor is detectable. For example, the yarn storage could include an elongated interior, in which the yarn is kept in the shape of a loop with the assistance of a vacuum. If the loop is located between the two sensors, which are to be placed adjacent to each other in the longitudinal direction of the interior, the filling level of the yarn storage corresponds to the target value. However, if both sensors detect the presence of a yarn section, the winding speed of the winding device should be increased by the controller to reduce the filling level of the yarn storage. If a yarn is not detected by any of the sensors, the controller should be designed to reduce the winding speed, in order to increase the filling level of the yarn storage (assuming there is no yarn break, which could be detected, for example, with the assistance of the yarn monitor). Alternatively, it would also be ultimately conceivable that the sensor system contains more than two sensors, preferably spaced from each other. Likewise, only one sensor could be present, which is able to monitor the filling level of the yarn storage on the basis of the presence of a yarn in one or more predetermined positions within the yarn storage. Generally, the sensor(s) may also be formed as camera(s), which are able to evaluate their captured images, for example, with the assistance of corresponding image analysis software, such that information with regard to the filling level of the yarn storage can be extracted from the images. Moreover, the sensor(s) may be formed as capacitive sensors, which are likewise suitable for detecting the presence of a yarn in one or more predetermined positions within the yarn storage.

There are also advantages if the spinning point is in operative connection with a controller, with the assistance of which the winding speed of the winding device is able to be influenced, depending on the information on the filling level of the yarn storage supplied by the sensor system. In this manner, it is ensured that the filling level of the yarn storage always corresponds to a value within defined limits. In this case, the yarn storage may both deliver and take in a certain length of yarn, and thus bring about the desired buffer effect during the production of the yarn. As a result, ultimately, fluctuations in the winding speed and/or the delivery speed of the spinning unit may be absorbed in a simple manner, without this leading to a yarn break.

Moreover, it is also advantageous if the spinning point includes a yarn brake downstream of the yarn storage in the direction of transport. The yarn brake may include, for example, a spring assembly, with the assistance of which a certain clamping force may be exercised on the yarn. Preferably, the clamping force is to be controlled, in particular by means of a controller (it should at least be possible to be able to switch on the yarn brake with the assistance of the controller only when necessary, in order to be able to enable or disable, as the case may be, the braking effect exerted on the yarn).

It is also advantageous if the spinning point includes a yarn separation unit, which is preferably placed in the area of the yarn storage. The yarn separation unit may include, for example, a blade unit, with the assistance of which a certain yarn section is able to be separated from the remaining yarn after the detection of a yarn break.

In connection with the yarn storage, it is also advantageous if this is connected to a vacuum power source. In this case, the yarn storage operators pneumatically and, when coupled with the vacuum power source, brings about a suction of the yarn section located in the area of the yarn storage. In particular, the yarn storage may be formed as a tube and may be connected with a corresponding vacuum power source through a switchable valve, such that the suction effect of the yarn storage can be enabled and disabled. Alternatively, the yarn storage could of course also include mechanically effective or working elements that allow for an intermediate accumulation of the yarn, for example through a winding process.

It is also advantageous if the yarn storage has at least one injection nozzle, with the assistance of which an air flow is able to be generated within the yarn storage, the flow of which is directed in a direction turned away from a yarn intake opening of the yarn storage. Because of the Venturi effect, the air flow brings about an amplification of the suction effect of the yarn storage. In particular, it is advantageous in this context if the injection nozzle(s) is/are in operative connection with a controller, which is formed to then feed the injection nozzle(s) with compressed air, if the yarn is to be partially unwound from the spool after a yarn break (this is particularly useful to ensure that not only the detected yarn fault, but also a correspondingly long yarn section preceding the yarn fault that likewise already deviates from the predetermined standard of quality, can be separated from the remaining yarn).

It is also advantageous if the spinning point has, preferably in the area of the yarn storage, a yarn end preparator for processing an end of the yarn prior to a subsequent piecing process. The yarn end preparator may be a component of the yarn storage, or may be placed in its immediate vicinity and connected to it through corresponding bracket sections. In this case, the end of the yarn may be mechanically processed accordingly (e.g., freed from the existing swirl of individual fibers) before the aforementioned return in the direction of the spinning process takes place. In particular, if the yarn storage, the specified yarn separation unit, and the yarn end preparator are structurally combined, this gives rise to a compact unit, which can be allocated to any of the individual spinning points of the spinning machine according to the invention.

It is also advantageous if the spinning point is connected with a controller, which is formed to operate the spinning point in accordance with one or more aspects of the following description.

The method according to the invention for the operation of a spinning machine (in particular with one or more of the previously described characteristics) is initially characterized in that, during the spinning process, the yarn produced in the spinning point is drawn off from the spinning point with the assistance of a drawing-off device, the drawn-off yarn is monitored with the assistance of a yarn monitor regarding at least one physical parameter, the drawn-off yarn passes through a yarn storage, the filling level of the yarn storage is monitored with the assistance of a sensor system, the yarn is wound on with the assistance of a winding device after passing through the yarn storage and the winding speed of the winding device is controlled depending on the filling level of the yarn storage. With regard to possible physical or design characteristics of the specified components, reference is made to the previous and following description.

As mentioned above, yarn breaks frequently arise during the spinning process, whereas a "yarn break", for the purposes of the invention, is understood to mean an unforeseeable tearing of the yarn or an active interruption of the yarn production through switching off or throttling of the spinning unit after the detection of a yarn fault, during which an end of the yarn also arises.

After such an event, in order to avoid the use of a service robot, it is proposed within the framework of the invention for, in the case of a corresponding yarn break, the winding device is to be stopped as immediately as possible. In any event, it is provided that the stopping of the winding device (i.e., the halting of the spool driven by the winding device) is effected before the yarn has completely passed through the yarn storage. In other words, the stopping of the winding device takes place in such a manner that, after its stop, an end section of the yarn remains within the yarn storage. This has the crucial advantage that, after the stopping of the winding device and the spinning unit, the yarn comes to lie at a defined spot of the spinning point. Therefore, prior to the introduction of the steps described below, the end of the yarn need not be—as is typical in the state of the art—searched for on the surface of the spool and removed from it. Rather, the yarn is able to be seized in the area of the yarn storage, such that time-consuming intermediate steps can be omitted.

In the next step, it is provided that a part of the yarn is separated with the assistance of a yarn separation unit internal to the spinning point. If, prior to the stopping of the winding device, a yarn fault was detected, it is expedient to separate the yarn fault and a certain section of yarn that was produced in front of the yarn fault, in order to ensure that, after the separation step, only yarn that corresponds to the quality requirements is found on the spool. For this purpose, it is preferable that a part of the yarn that is already wound on is once again unwound from the spool, in order to enable a separation of the desired section of the yarn.

Finally, it is provided that the end of the yarn that is newly created in this manner is returned with the assistance of a return unit internal to the spinning point in the area of the spinning point, and a piecing process is then carried out, for which the end of the yarn is connected to the fiber composite supplied to the spinning unit, in order to be able to continue with the internal spinning process.

In connection with the aforementioned return of the yarn, it is advantageous if this takes place with the assistance of an air flow, or with the assistance of a mechanically operated return element, such as a lever assembly, whereas the relevant components (air jet/lever assembly) are preferably formed as a component of the respective spinning point. In this manner, the desired independent piecing process is possible, for which the use of the service robot may be avoided. During the return of the end of the yarn into the area of the spinning unit, it is also advantageous if the yarn storage, which is preferably pneumatically operated, is disabled. This prevents two forces acting in the opposite direction from being exercised on the end of the yarn, which could conflict with the return of the yarn.

Furthermore, it is advantageous if, during the spinning operation, the yarn is kept in tension with the assistance of a yarn brake placed between the yarn storage and the winding device. For example, it is conceivable that the yarn is led through a clamping or a deflecting element, such that it is ensured that it is wound on the corresponding spool cleanly and without unwanted formation of loops.

It is likewise advantageous if, during the spinning operation, the filling level of the yarn storage is monitored with the assistance of at least one sensor. This can ensure that the filling level (i.e., the length of the section of yarn located in the yarn storage) is always between a defined minimum value and a likewise predetermined maximum value. If the filling level is above the maximum value, the winding speed of the winding device should be increased to reduce the filling level of the yarn storage. However, if the minimum value is not reached, the winding speed should be reduced in order to increase the length of the end of the yarn in the yarn storage.

It is also advantageous if, during or after the stopping (following a yarn break) of the winding device, an air flow is produced within the yarn storage, which is directed in a direction turned away from a yarn intake opening of the yarn storage. In particular, if the yarn storage is pneumatically operated, i.e., the yarn is sucked in with the assistance of a vacuum flow, given the air flow that is additionally introduced, the suction effect on the yarn can be amplified due to the Venturi effect. Such an amplified suction effect of the yarn storage on the yarn is particularly desirable in the stage of the method in which a certain section of yarn is unwound again from the spool, in order to, after a yarn break, be able to remove a necessary part of the yarn from the remaining yarn. In particular, it is also provided during this time period that the yarn brake (if any) is disabled, in order to make the unwinding of the yarn from the spool easier.

Herein, it is expressly advantageous if a length of yarn corresponding to the unwound yarn length is taken from the yarn storage. After the completion of the winding process, the end section of the yarn taken from the yarn storage is finally separated from the remaining yarn, preferably with the assistance of a yarn separation unit placed in the area of the yarn storage, and led away with the assistance of the yarn storage. For this purpose, the yarn storage may run over into an air pipe, which is in turn connected to a vacuum power source.

It is advantageous if the resulting end of the yarn is processed with the assistance of a yarn end preparator, preferably mechanically, and then returned into the area of the spinning unit. As a result, the quality of the subsequent piecing process may be significantly increased, whereas, within the framework of the yarn end preparation, the twist of the yarn (for example) is removed.

There are also advantages if, during the return of the yarn, an air flow within the spinning unit is produced that is directed in the opposite direction of the direction of transport. This brings about a suction of the end of the yarn, which is led into the area of the spinning unit with the assistance of the return unit internal to the spinning point (for example, in the form of an air jet). During the return, it is suitable to release and/or disable the yarn brake, and operate the spool in reverse, such that an additional section of the yarn is released. This ensures that the end of the yarn can be led up to the area of the spinning unit and/or an area of the spinning unit that is upstream in the direction of transport.

BRIEF DESCRIPTION OF THE DRAWINGS

Additional advantages of the invention are described in the following embodiments. The following is shown.

DETAILED DESCRIPTION

Figure 1:
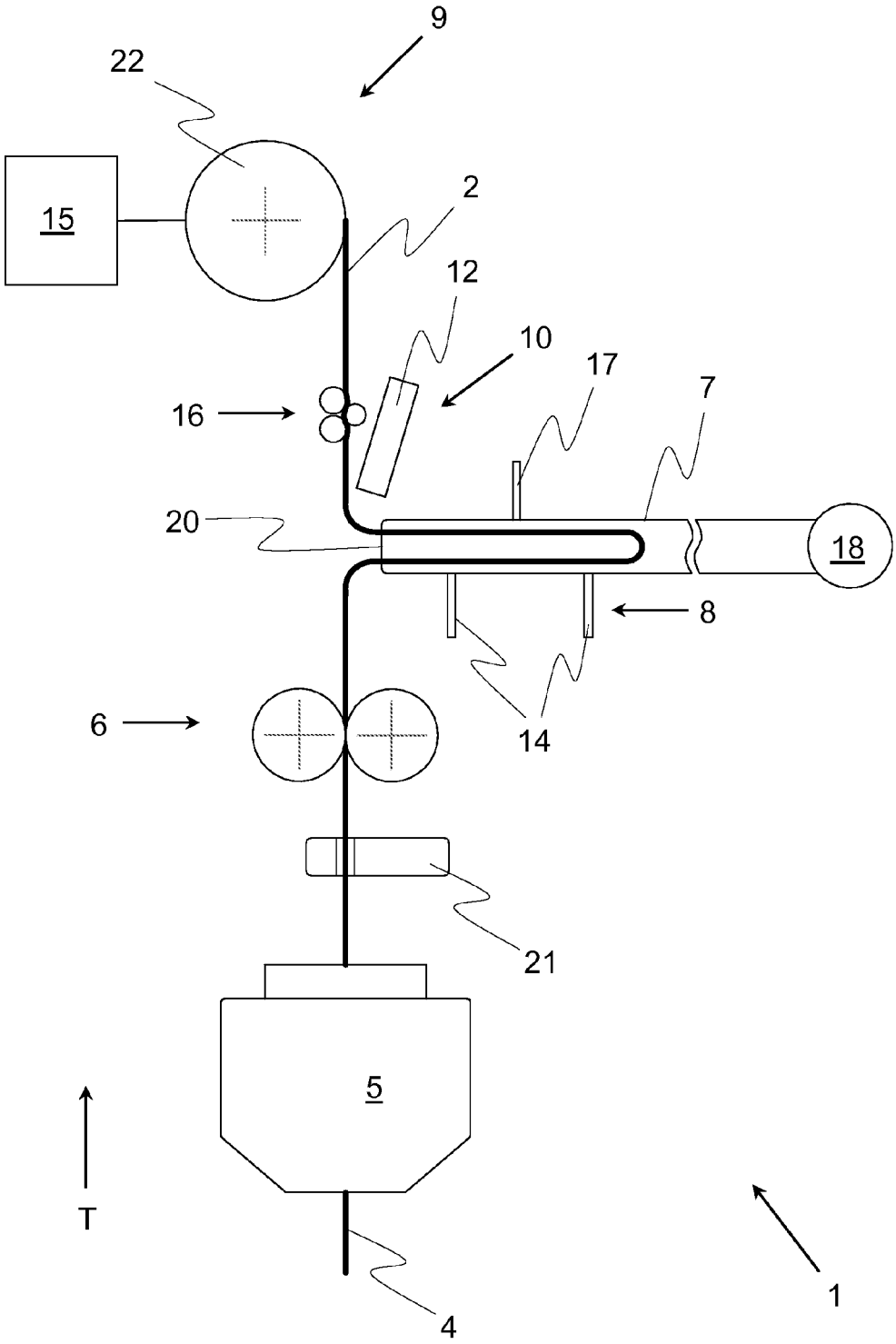
FIGS. 1 to 9 schematic representations of a spinning unit according to the invention during the removal of a yarn fault, FIGS. 10 and 11 the area of the yarn storage of a spinning point according to the invention, and FIG. 12 an alternative embodiment of a yarn storage of a spinning point according to the invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic representation of a spinning point 1 of a spinning machine according to the invention (which may be formed, for example, as an air-jet spinning machine or a rotor spinning machine) during the spinning process, during which a yarn 2 is produced from a fiber composite 4. Herein, the fiber composite 4 is generally fed with the assistance of a drafting system (air-jet spinning machine) or an opening unit (rotor spinning machine) of a corresponding spinning unit 5 known in the state of the art (an air vortex chamber in the case of an air-jet spinning machine, or a rotor chamber in the case of a rotor spinning machine), and provided with a twist within the spinning unit 5. While only one spinning point 1 is shown in the figures, the corresponding spinning machine may of course also include several spinning points 1, for example arranged one after the other perpendicular to the drawing layer, and preferably uniformly structured.

The spinning point 1 that is shown also includes a drawing-off device 6 formed by, for example, a pair of draw-off rollers, with the assistance of which the yarn 2 is able to be drawn from the spinning unit 5 in a direction of transport with a predetermined drawing-off speed, along with a winding device 9 downstream of the drawing-off device 6, which features a replaceable spool 22. The winding device 9 serves the purpose of winding on the yarn 2 exiting the spinning nozzle, which leaves the spinning unit 5 through a corresponding yarn outlet.

In order to be able to monitor the quality of the produced yarn 2, the spinning machine according to the invention also has a yarn monitor 21, which monitors defined physical parameters of the yarn 2 (such as its hairiness, the yarn thickness, the yarn strength or other parameters representative of the quality of the yarn 2). Thereby, the yarn monitor 21 operates preferably without contact, and is also particularly formed to detect the presence of the yarn 2 in the area of the yarn monitor 21 itself.

Finally, the spinning machine according to the invention possesses additional characteristic components/units that are more specifically addressed in the following description.

Figure 2:
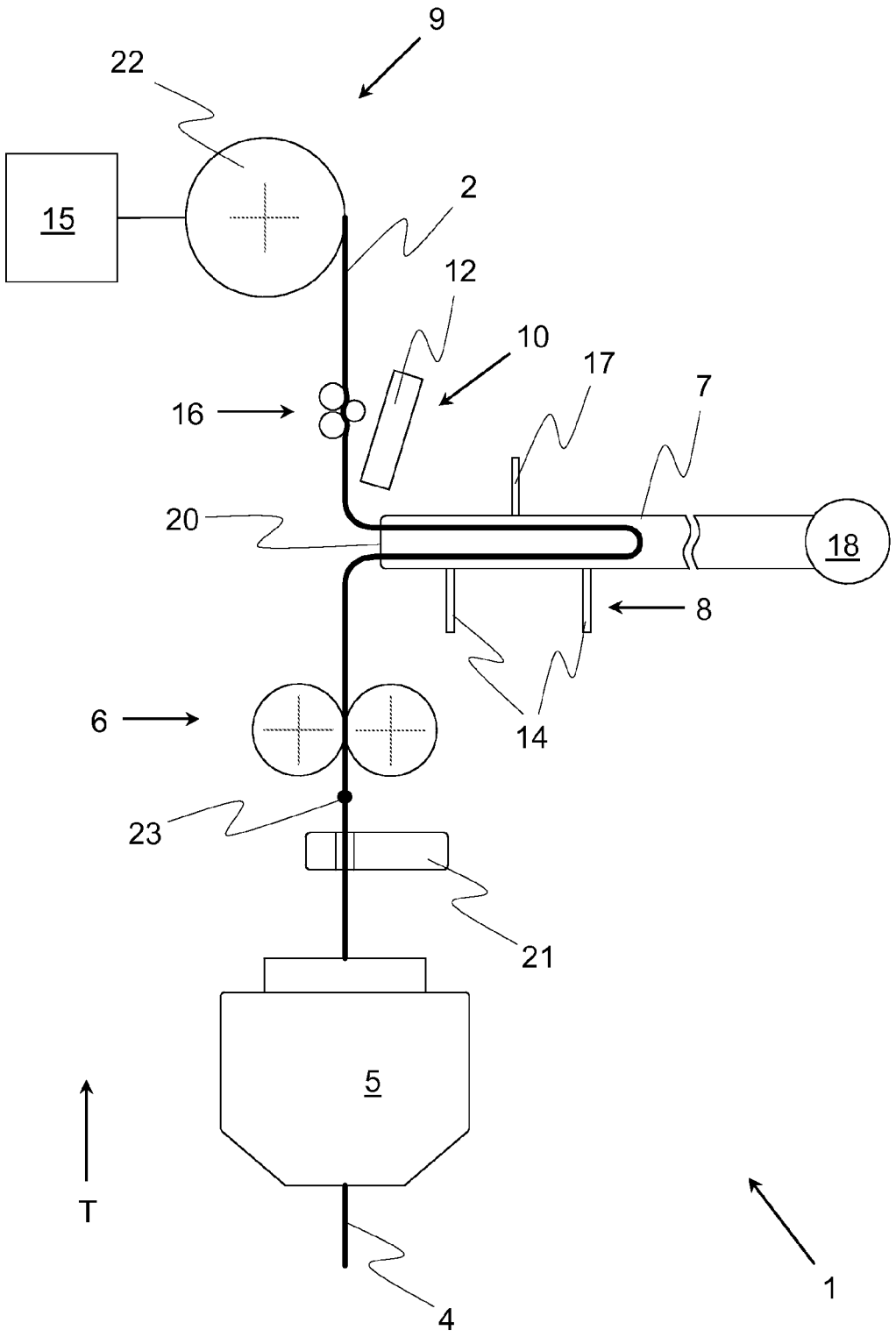

It must be initially noted that, in regular intervals during the spinning operation, yarn faults 23 (FIG. 2) (defined as a certain deviation of the monitored yarn parameter from a target value) arise. With conventional air-jet spinning machines, the removal of such yarn faults 23 (so-called "cleaner cuts") is carried out along the spinning points 1 by a patrolling service robot, but it is the case that only one yarn fault 23 per time window is able to be removed, and the process must initially take place at the corresponding spinning point 1 before the necessary piecing process can be started. If yarn faults 23 simultaneously appear at several spinning points, this leads to a loss of production, which negatively affects the productivity of the spinning machine as a whole.

Likewise, a tearing of the yarn 2 may also occur during the production of the yarn, whereas in this case a piecing is necessary to be able to resume the spinning process.

According to the invention, the spinning point 1 has a yarn storage 7 described in the following, a yarn separation unit 17 along with a return unit 10, with the assistance of which a piecing is possible after a yarn break (tearing of the yarn or a controlled stopping of yarn production with the consequence that an end of the yarn also arises), without herein a service robot having to proceed at the corresponding spinning point 1. In other words, the described spinning point 1 allows for an independent piecing process after the detection of a yarn fault 23 or a tear of the yarn 2.

In the following, reference is made to FIGS. 2 to 9. As is apparent therein, during the normal spinning process, the yarn 2 is drawn off from the spinning unit 5 with the assistance of a drawing-off device 6 and monitored by a yarn monitor 21 (which need not necessarily be placed at the position shown). After the drawing-off device 6, the yarn 2 continuously goes through a yarn storage 7, which is preferably pneumatically operated. It is therefore advantageous if the yarn storage 7 includes, for example, a tube-shaped storage volume with a yarn intake opening 20, which in turn is connected to a vacuum power source 18.

Through the airflow that arises based on the vacuum, the yarn 2 is drawn into the yarn storage 7 in the shape of a loop, and thus kept in tension.

Finally, the yarn 2 preferably passes through a yarn brake 16, which ensures that the yarn 2 may be wound up on the spool 22 under a certain tension (under certain circumstances, a yarn brake 16 may be dispensed with, since the yarn storage 7 already exerts a certain tension on the yarn 2).

Finally, the yarn 2 is wound on a spool 22 with the assistance of the winding device 9 (which preferably includes a traversing unit for the yarn 2), whereas the winding speed is preferably controlled with the assistance of a controller 15 depending on the measured values that are supplied by a sensor system 8 placed in the area of the yarn storage 7. The sensor system 8 may include, for example, two adjacent sensors 14, which are placed at various distances from the yarn intake opening 20, and are able to detect the presence of the yarn 2 in the area of the respective sensor 14. If the sensor system 8 indicates that the yarn loop shown in FIG. 1 is located between the first and second sensor 14, this is a sign that the winding speed approximately corresponds to the drawing-off speed of the drawing-off device 6. If both sensors 14 detect the presence of a yarn 2 (as shown in FIG. 1), this is a sign that the winding speed is lower than the drawing-off speed, since the yarn storage 7 has been overly filled. In this case, the controller 15 increases the winding speed of the winding device 9 until the yarn loop is once again located between the two sensors 14. However, if both sensors 14 indicate that there is no yarn 2 in their area (although the yarn monitor 21 reports the presence of a yarn 2), the winding speed must be reduced until the yarn storage 7 has once again been sufficiently filled (i.e., until the yarn loop is once again located between the two sensors 14).

Figure 3:
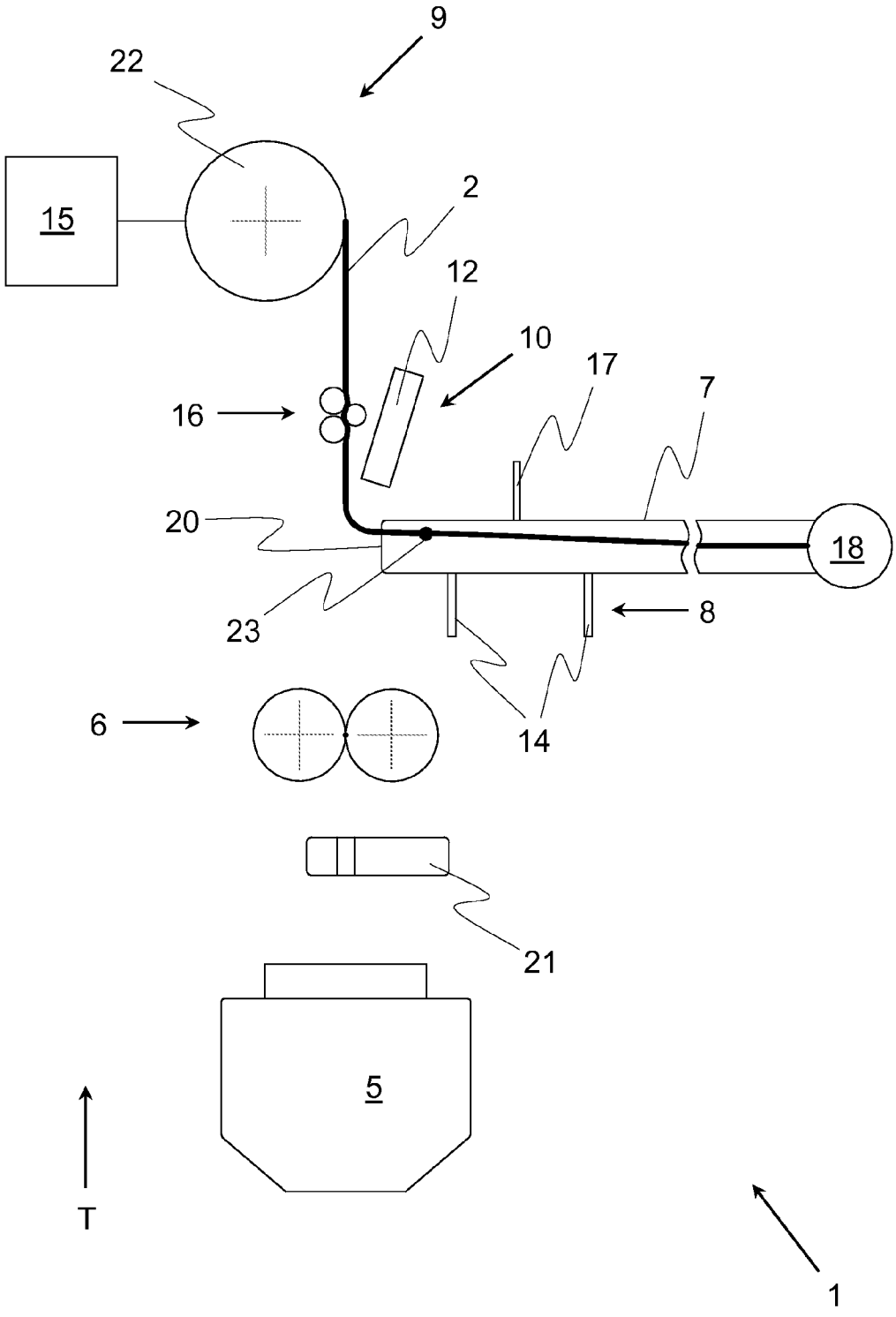

If, at that point, a tearing of the yarn 2 arises, or the yarn 2 exhibits a yarn fault 23, the respective event is detected by the yarn monitor 21, and is reported to the controller 15 of the spinning point 1 and/or the spinning machine. If a yarn fault 23 has been detected, the spinning unit 5 deliberately shuts down until the yarn 2 is no longer produced. At the same time, the winding device 9 stops in such a manner that the end of the yarn 11 on the winding-on side arising from the production stop is located within the yarn storage 7 or between the yarn storage 7 and the spinning unit 5 (FIG. 3). If a tearing of the yarn 2 arises during the spinning operation, the winding device 9 is also immediately stopped, in order to ensure in this case that the end of the yarn 11 is found at one of the specified positions after the stop.

In any event, it must also be ensured that, upon a yarn break, the winding device 9 is stopped as quickly as possible, in order to prevent a complete winding-on of the end of the yarn 11 (this would have to be elaborately searched for on the surface of the spool prior to a piecing process).

FIG. 3 shows the location of the yarn 2 after the stopping of the winding device 9. As is apparent from this figure, the end of the yarn 11 is located within the yarn storage 7, and is sucked in by the vacuum power source and thus kept in tension (incidentally, the yarn 2 would also take a comparable position if it had been a spontaneous tear of the yarn, whereas a yarn fault 23 does not necessarily have to exist here).

Figure 4:
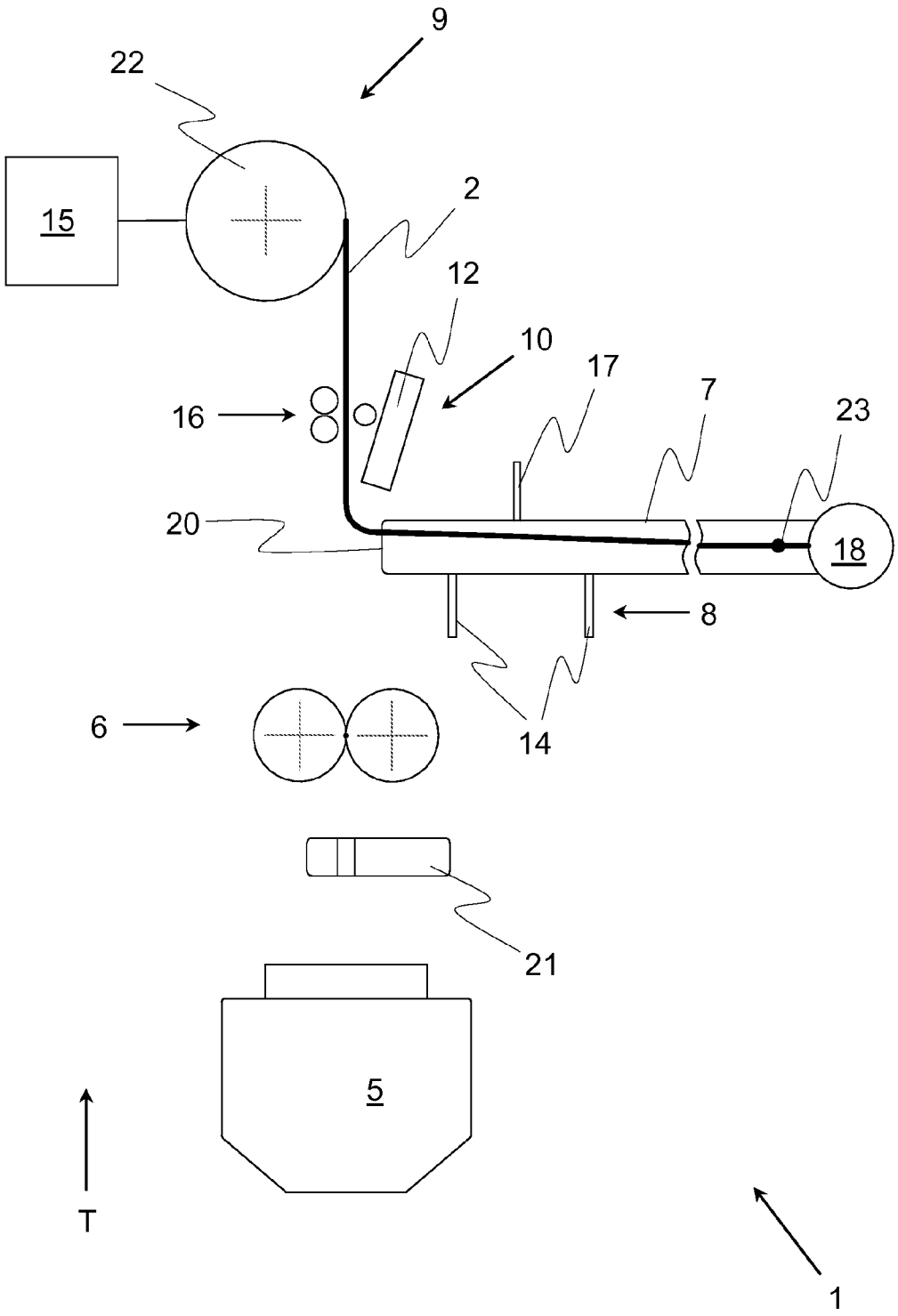
Figure 5:
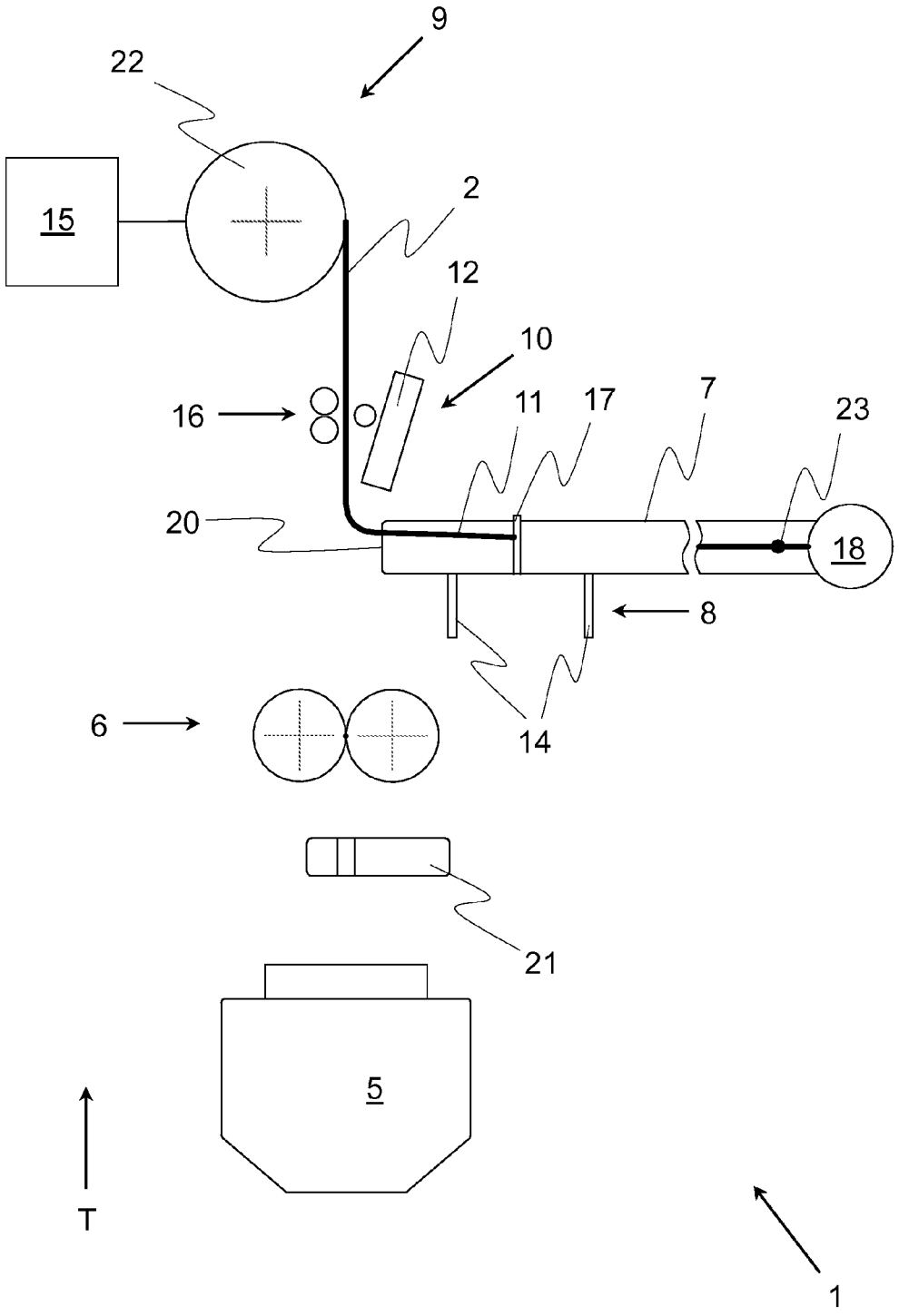

In the next step, there is an unwinding of a certain yarn section from the spool 22 (this is driven in reverse if there is a disabled yarn brake 16), in order to ensure that the yarn fault 23 is able to be separated by a yarn separation unit 17 (see FIGS. 3 and 4). Moreover, if there is a tear of the yarn, it is sensible to separate a certain end section of the yarn 2 prior to a subsequent piecing process, in order to ensure that the remaining yarn 2 meets the predetermined quality requirements.

Figure 6:
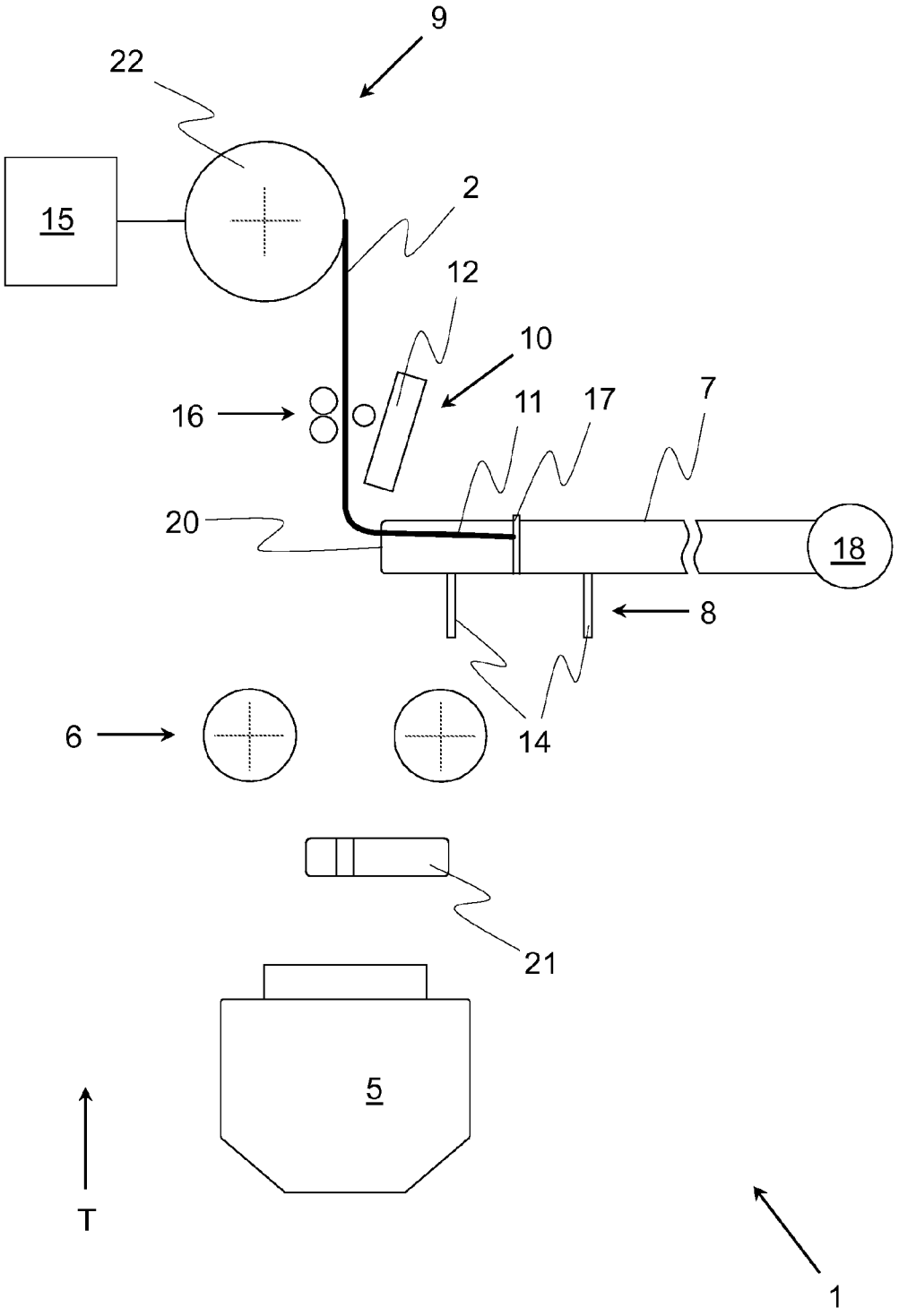
Figure 7:
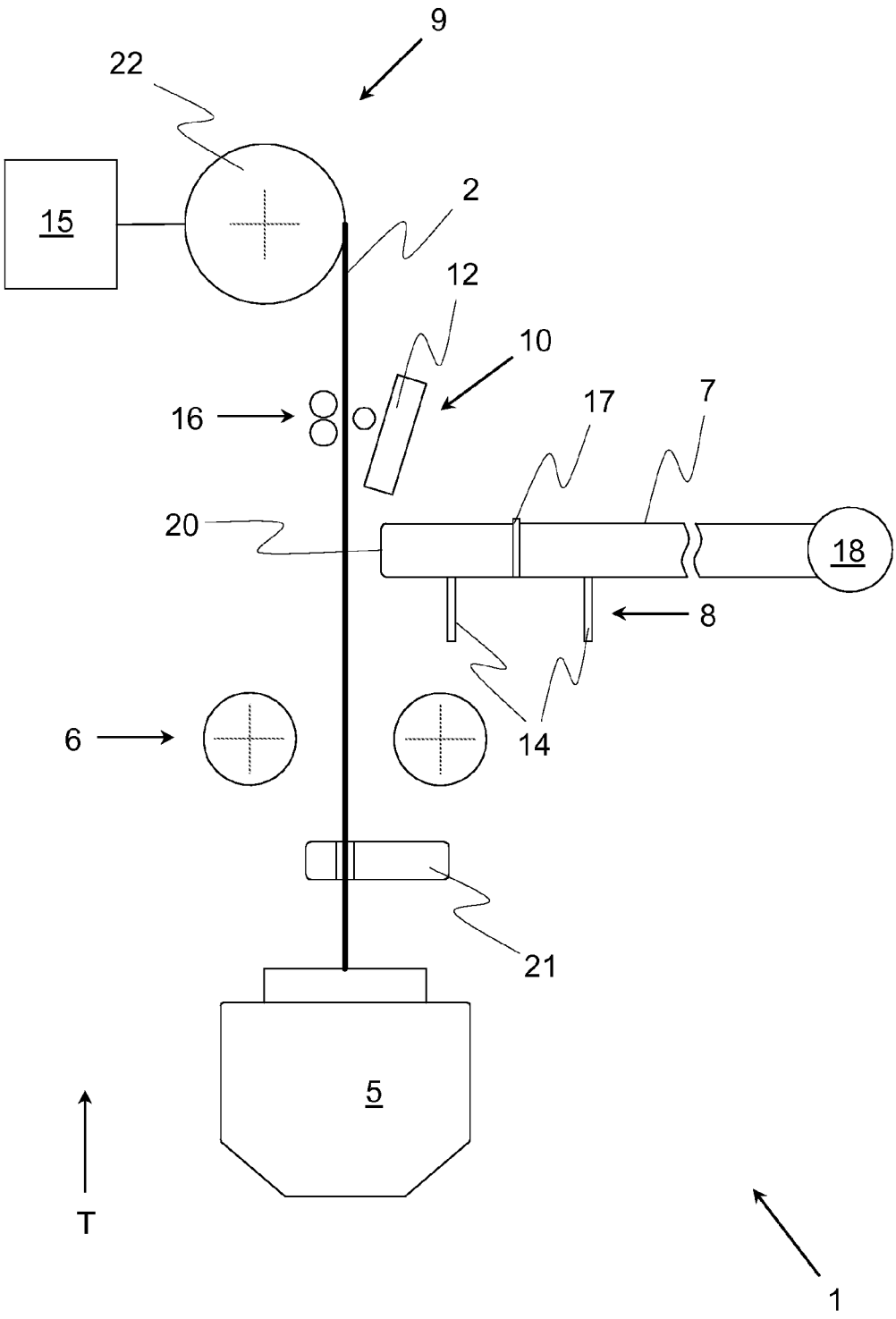
Figure 8:
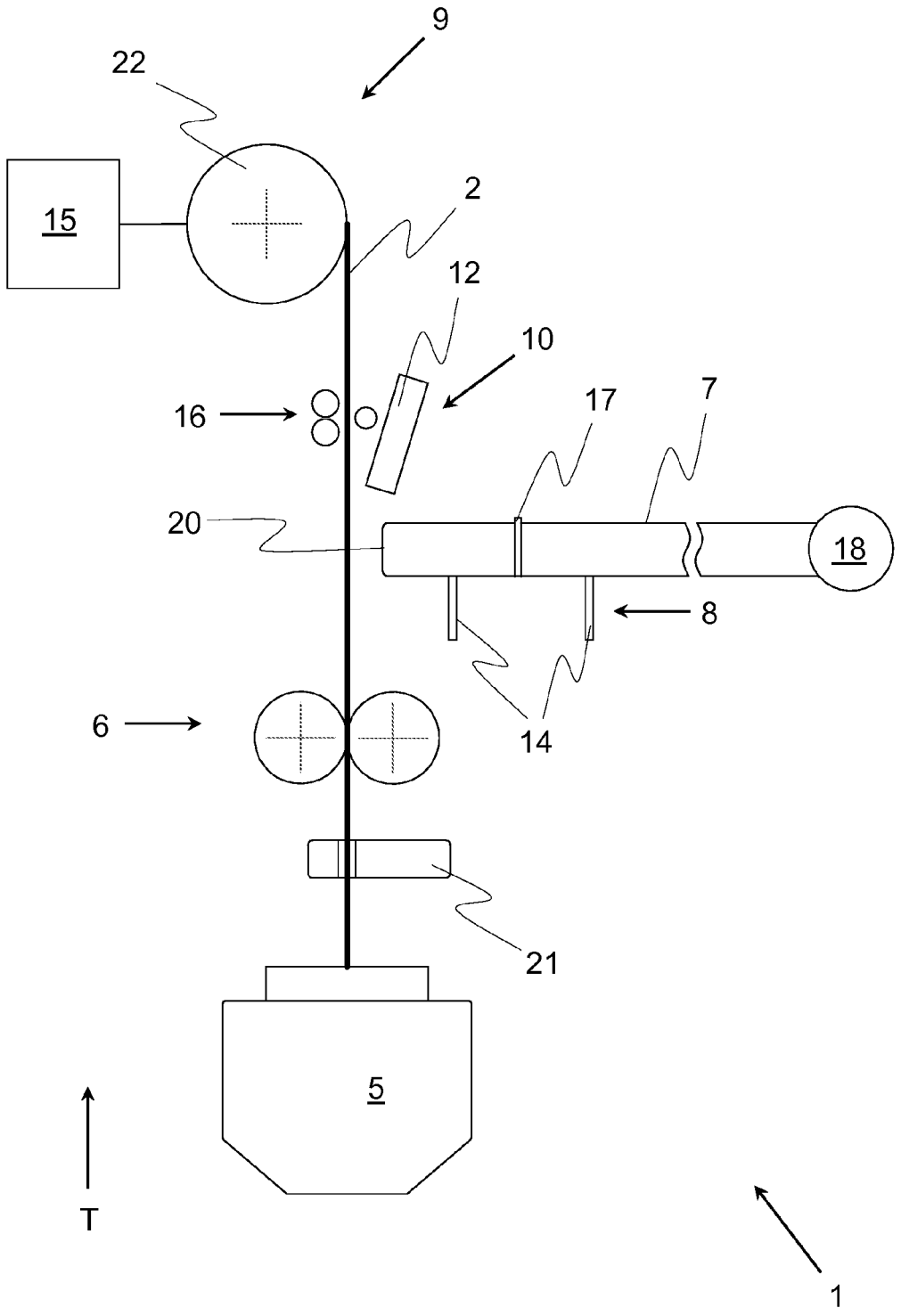

In the next step, there is a separation of a corresponding long end section of the yarn 2 with the assistance of the yarn separation unit 17 (FIG. 5) and the suction of the separated yarn section with the assistance of the vacuum power source 18 or a disposal section associated with it (FIG. 6).

In order to lead the newly created end of the yarn 11 back into the area of the spinning point 1, for ultimately carrying out the necessary piecing process, the spinning point 1 according to the invention possesses a return unit 10, which in the case of FIGS. 1 to 9 includes an air jet 12, in order to be able to generate an air flow, which extends from the yarn storage 7 (in particular, its yarn intake opening 20) in the direction of the spinning unit 5 (preferably its yarn outlet opening).

If the air jet 12 is subject to excess pressure, the end of the yarn 11 that has been released from the yarn storage 7 in the interim is blown ("shot") in the direction of the spinning unit 5, whereas, for this purpose, the drawing-off device 6 (if applicable) must be brought into a corresponding position, in which it is not located in the flight path of the end of the yarn 11 (in FIG. 6, the two draw-off rollers have been moved away from each other for this purpose). If the distance between the end of the yarn 11 and the spinning unit 5 is greater than the length of the section of the yarn found before the described yarn return in the yarn storage 7, prior to or during the yarn return supported by the return unit 10, a corresponding quantity of yarn should be unwound from the spool 22, such that the end of the yarn 11 can ultimately be sucked in by the spinning unit 5 (see FIG. 7).

Figure 9:
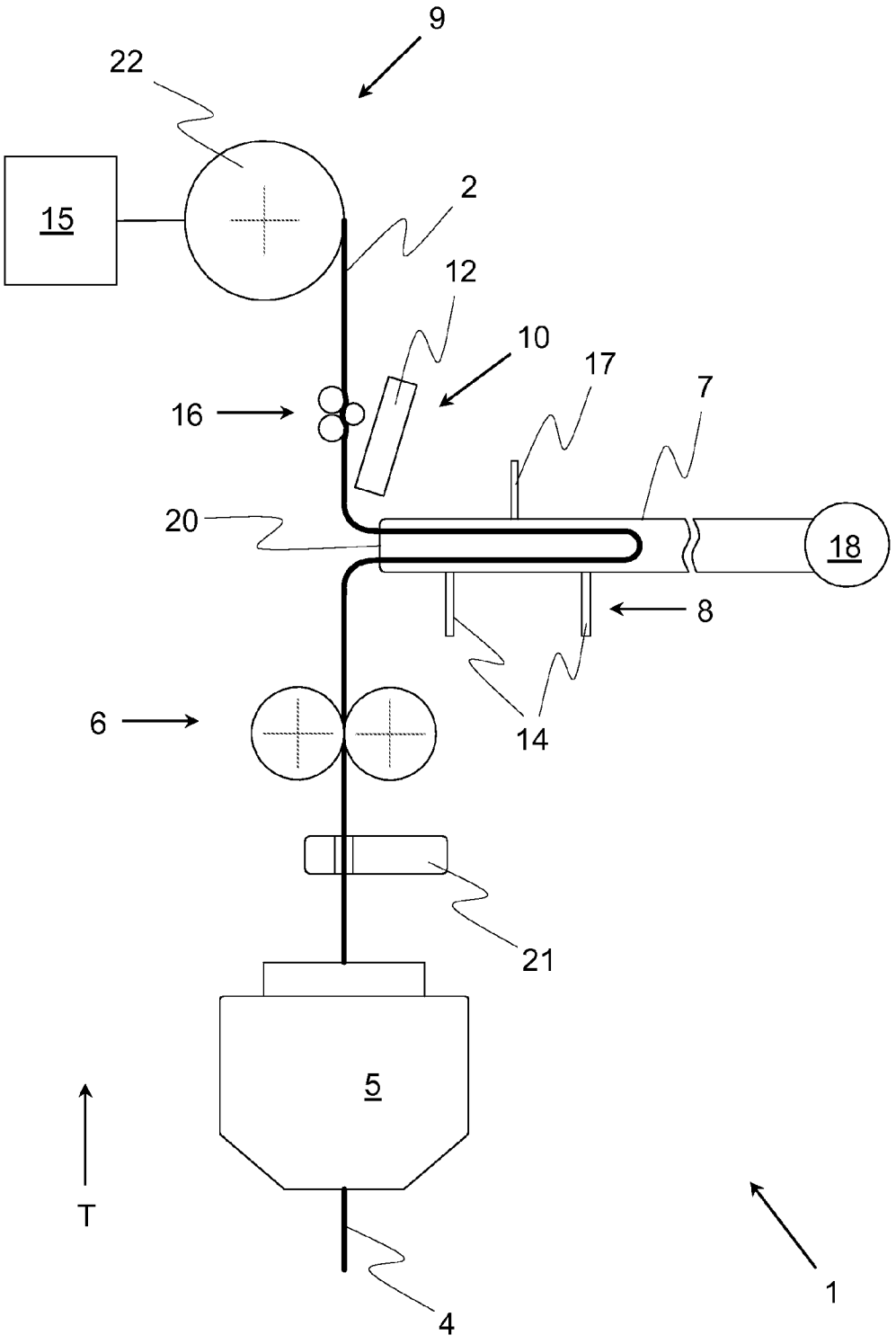

Finally, the drawing-off device 6 is once again brought into its operating position, the section of the yarn required for the piecing process is unwound from the spool 22, such that the end of the yarn 11 is located at the position (for example, in the direction of transport seen in front of the spinning unit 5) provided for the piecing process (i.e., the connection with the fiber composite 4 and/or a section of the yarn produced in the interim by the spinning unit 5), and the yarn storage 7 is once again filled to the desired level (FIG. 9).

Upon completion of the piecing process, the regular spinning process can be resumed, without the use of a service robot being necessary for this purpose.

Figure 10:
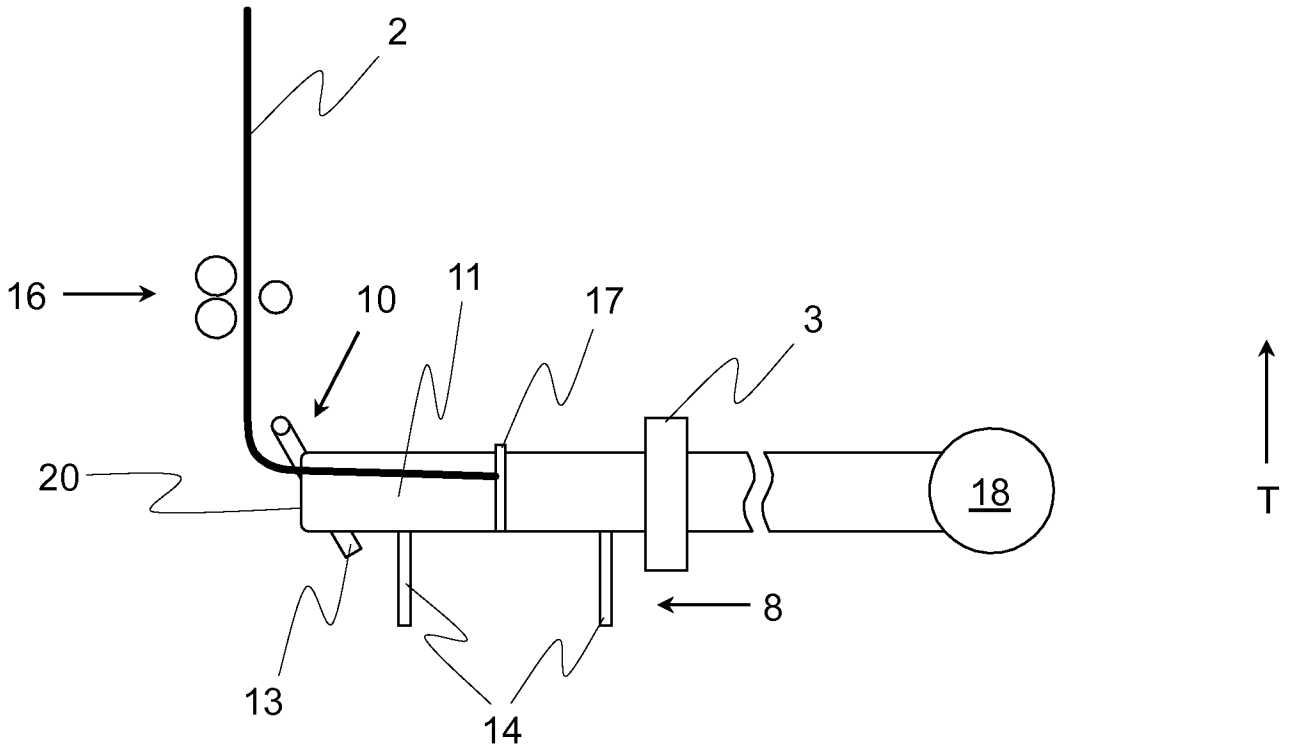
Figure 11:
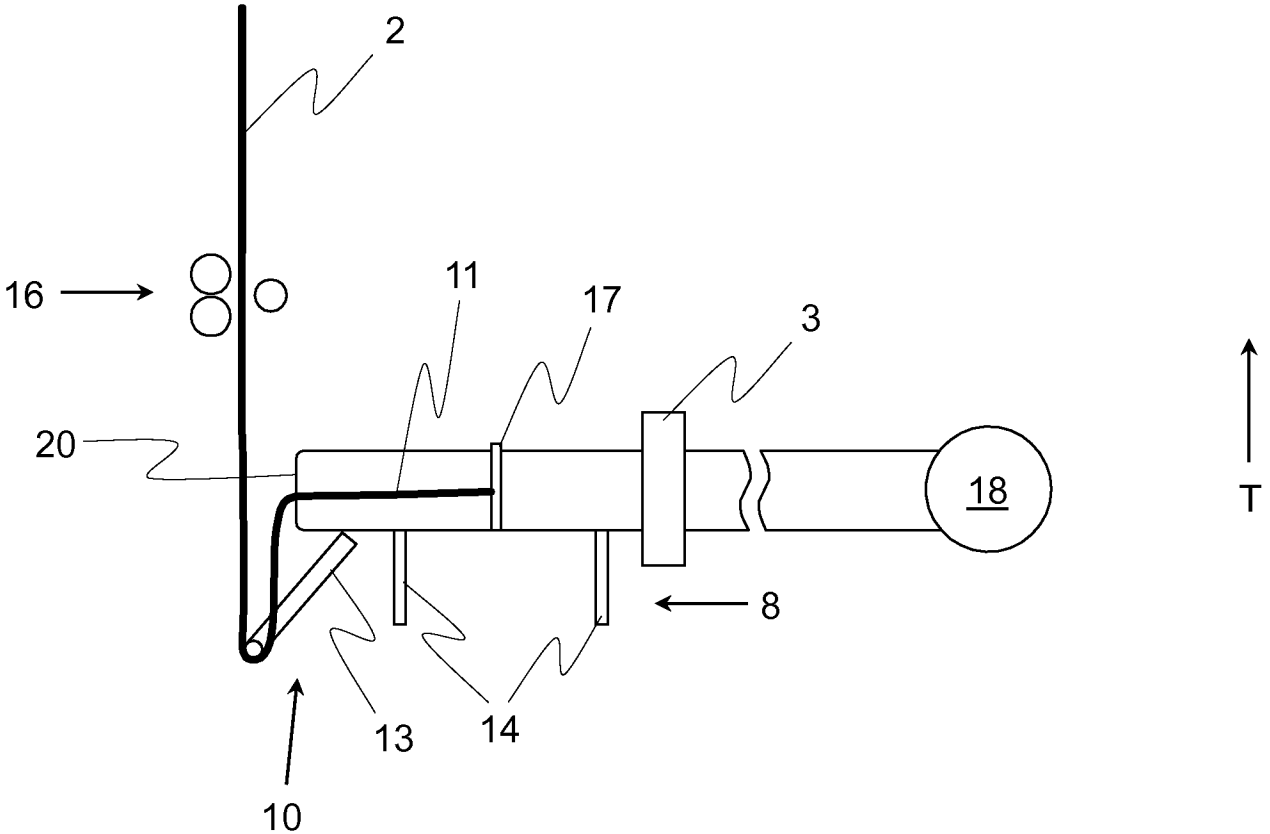

Finally, FIGS. 10 and 11 show an alternative embodiment of the described return unit 10. Instead of or in addition to the air jet 12 that was already shown, it can likewise be advantageous if the return of the end of the yarn 11 is accomplished in the area of the spinning unit 5 with the assistance of a mechanical return element. For this purpose, the spinning point 1 may have, for example a lever assembly 13, which, upon delivering to an axis of rotation, may cause a movement of the end of the yarn 11 in accordance with FIG. 11 (during the motion of the lever assembly 13, the yarn storage 7 may be subject to a vacuum, in order to enable the formation of the loop shown in FIG. 11; if the vacuum power source 18 is decoupled from the yarn storage 7, the loop would be finally released and the end of the yarn 11 pointing down would be sucked in by the spinning unit 5).

Moreover, FIG. 11 shows that the yarn storage 7 may also feature a yarn end preparator 3. This serves the purpose of, after the separation of a corresponding section of the yarn, processing the end of the yarn 11, in order to prepare it for the subsequent piecing process. Herein, a twist release can take place (for example), in order to be able to better connect with the fibers of the fiber composite 4.

Figure 12:
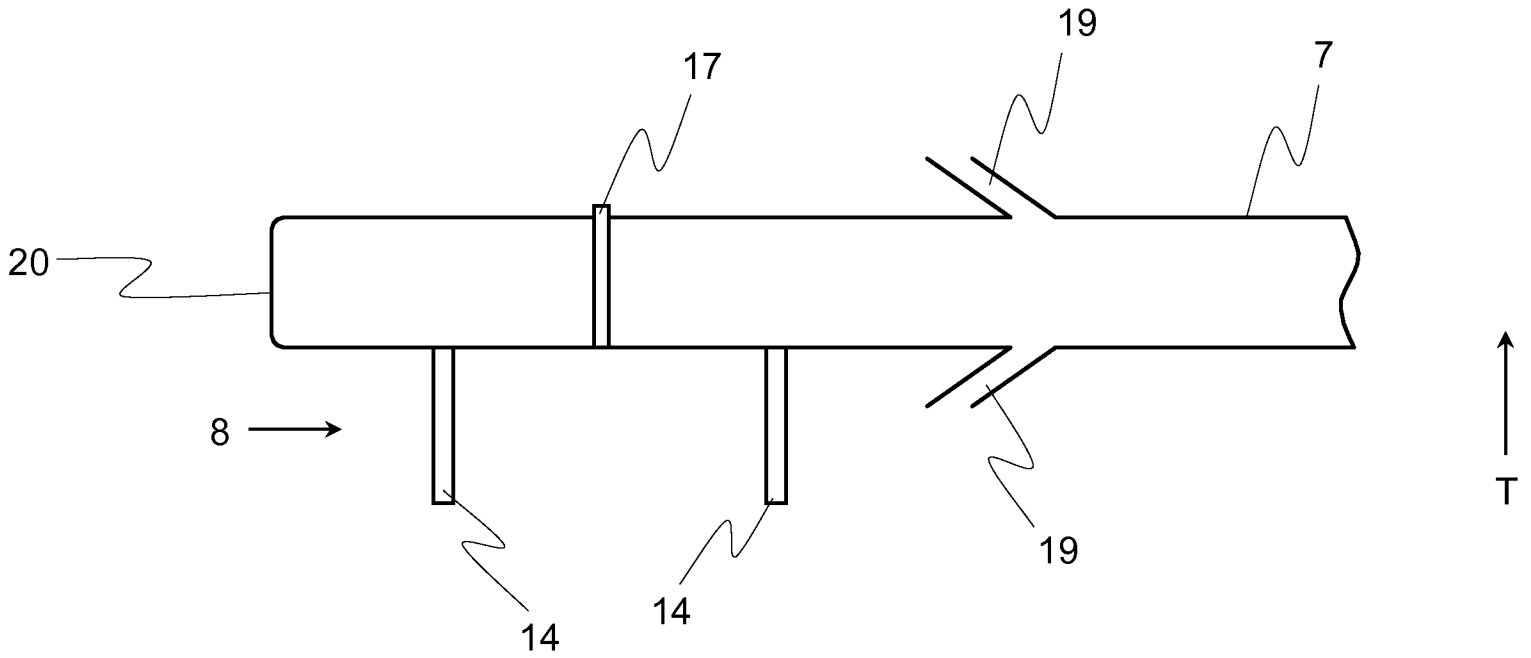

Finally, an advantageous embodiment of the previously described yarn storage 7 is shown in FIG. 12. As is apparent from this figure, it may be provided that one or more injection nozzles 19 flow into the interior of the yarn storage 7. The injection nozzle(s) 19 is/are also connected to an air pressure source, such that an air flow is able to be generated, which air flow extends in a direction turned away from the yarn intake opening 20. As a result, during the unwinding process of the yarn 2 shown in FIGS. 4 and 5, the pulling force on the yarn 2 or the end of the yarn 11 may be ultimately increased, such that, for the return of the yarn, it may be sufficient to disable the drive of the spool 22, without having to actively shift the spool 22 into a reverse direction.

This invention is not limited to the illustrated and described embodiments. Variations within the framework of the patent claims, such as a combination of features, are also possible, even if they are presented and described in different embodiments.

The invention claimed is:

1. A spinning point of a spinning machine for producing a yarn from a fiber composite that is supplied to the spinning point, the spinning point comprising:

a spinning unit;

a drawing-off device downstream of the spinning unit in a direction of transport of the yarn from the spinning unit;

a yarn storage downstream of the drawing-off device;

a sensor system configured with the yarn storage that monitors a fill level of the yarn within the yarn storage;

a winding device downstream of the yarn storage; and a return unit disposed relative to the yarn storage and activatable after a yarn break to remove an end of the yarn located within the yarn storage and direct the removed yarn end to the spinning unit.

2. The spinning point as in claim 1, wherein the return unit comprises an air jet disposed adjacent to an opening of the yarn storage to direct an air flow against the yarn entering the yarn storage and towards the spinning unit.

3. The spinning point as in claim 1, wherein the return unit comprises a mechanical lever assembly disposed adjacent to an opening of the yarn storage to contact and move the yarn end out of the yarn storage and towards the spinning unit.

4. The spinning point as in claim 1, wherein the sensor system comprises two sensors spaced apart along the yarn storage, each of the sensors configured to detect the presence of a yarn adjacent the respective sensor within the yarn storage.

5. The spinning point as in claim 1, further comprising a controller in communication with the winding device and the sensor system, wherein a winding speed of the winding device is controlled as a function of a sensed fill level of yarn within the yarn storage.

6. The spinning point as in claim 1, further comprising a yarn brake downstream of the yarn storage.

7. The spinning point as in claim 1, further comprising a yarn separation unit operably configured along the yarn storage to separate the yarn within the yarn storage prior to a piecing process.

8. The spinning point as in claim 1, wherein the yarn storage is connected to a vacuum source.

9. The spinning point as in claim 1, wherein the yarn storage further comprises an air injection nozzle disposed to direct pressurized air into the yarn storage in a direction away from an open end of the yarn storage to increase tension on the yarn within the yarn storage in an unwinding direction prior to a piecing process.

10. The spinning point as in claim 1, further comprising a yarn end preparer configured with the yarn storage to prepare an end of the yarn within the yarn storage for subsequent piecing.

11. A method for operating a spinning point of a spinning machine for producing a yarn in a spinning operation from a fiber composite that is supplied to the spinning point, the method comprising:

drawing off the yarn produced at a spinning unit with a drawing-off device;

monitoring the drawn-off yarn with a yarn monitor for at least one physical characteristic of the yarn;

passing the drawn-off yarn through a yarn storage;

monitoring a fill level of the yarn within the yarn storage;

winding the yarn that passes through the storage device with a winding device;

controlling the winding speed of the winding device as a function of the monitored fill level of the yarn within the yarn storage device;

in the event of a yarn break, performing the following method steps:

stopping the winding device such that an end section of the yarn is located within the yarn storage;

separating a part of the yarn to define a new yarn end for piecing;

engaging the yarn entering the yarn storage, removing the new yarn end from the storage device and returning the new yarn end from the yarn storage to the spinning unit for subsequent piecing.

12. The method as in claim 11, wherein the new yarn end is returned to the spinning unit with assistance of a directed air flow or a mechanical lever.

13. The method as in claim 11, further comprising keeping a tension on the yarn produced in the spinning operation with a yarn brake disposed between the yarn storage and the winding device.

14. The method as in claim 11, wherein the fill level of the yarn within the yarn storage is monitored with at least one sensor disposed at a location along the yarn storage.

15. The method as in claim 11, wherein either during or after the stopping of the winding device after a yarn break, an air flow is directed into the yarn storage in a direction away from an open yarn-intake end of the yarn storage.

16. The method as in claim 15, wherein during the directed air flow into the yarn storage, the winding device is controlled to unwind a section of yarn from a spool, whereas a length of the unwound yarn corresponds to a length of the yarn sucked into the yarn storage prior to separating the yarn to define a new yarn end.

17. The method as in claim 16, wherein subsequent to the unwinding of the section of yarn, the yarn within the yarn storage is separated and a separated yarn section is removed by the yarn storage.

18. The method as in claim 17, wherein the new yarn end defined after the separating of the yarn is prepared for piecing by a yarn end preparer prior to returning the new yarn end to the spinning unit.

19. The method as in claim 18, wherein the new yarn end is returned to the spinning unit with assistance of an air flow directed towards the spinning unit.

* * * * *